US005156030A

United States Patent [19]

Hill et al.

[11] Patent Number: 5,156,030

[45] Date of Patent: Oct. 20, 1992

[54] KEY SAFE FOR DOOR

[75] Inventors: Otho D. Hill, Las Vegas, Nev.; Porter Hoagland, Jr., Noank, Conn.

[73] Assignee: Otho D. Hill, Las Vegas, Calif.

[21] Appl. No.: 661,585

[22] Filed: Feb. 26, 1991

[51] Int. Cl.[5] ..... E05B 65/52

[52] U.S. Cl. ..... 70/63; 109/46; 109/47; 109/50; 109/51

[58] Field of Search ..... 109/59 R, 54, 59 T, 109/46, 47, 50–52, 45; 70/63, 388

[56] References Cited

U.S. PATENT DOCUMENTS

| | | | |
|---|---|---|---|
| 793,546 | 6/1905 | Scott | 109/47 |
| 851,744 | 4/1907 | Gustafson | 109/59 |
| 1,590,007 | 6/1926 | West . | |
| 1,885,692 | 11/1932 | Dugan . | |
| 1,955,809 | 4/1934 | Hobbs | 70/63 X |
| 2,139,909 | 12/1938 | Park . | |
| 2,253,332 | 8/1941 | Jackson . | |
| 2,672,043 | 3/1954 | Folscheid | 109/47 |
| 2,732,816 | 1/1956 | Stein . | |
| 2,737,910 | 3/1956 | Shuman . | |
| 3,084,008 | 4/1963 | Mallett . | |
| 3,347,069 | 10/1967 | Hollingshead, Jr. | 70/63 |
| 3,411,046 | 11/1968 | Swannick . | |
| 3,677,042 | 7/1972 | Atkinson | 70/312 X |
| 3,795,417 | 3/1974 | Cohen | 70/70 |
| 3,800,571 | 4/1974 | Heine | 70/71 |
| 3,820,363 | 6/1974 | Bako-et al. | 70/312 |
| 4,296,617 | 10/1981 | Campagna | 70/63 |
| 4,354,367 | 10/1982 | Wahl | 70/333 A |
| 4,467,628 | 8/1984 | Zampini | 70/312 |
| 4,615,281 | 10/1986 | Gaston | 109/50 |
| 4,651,544 | 3/1987 | Hungerford | 70/63 |
| 4,768,021 | 8/1988 | Ferraro | 70/63 X |
| 4,800,822 | 1/1989 | Adkins | 109/59 R X |
| 4,829,796 | 5/1989 | Kim | 70/63 X |
| 4,838,052 | 6/1989 | Williams et al. | 70/63 |
| 5,060,491 | 10/1991 | Smith | 70/63 |

FOREIGN PATENT DOCUMENTS

| | | | |
|---|---|---|---|
| 67021 | 6/1948 | Denmark | 49/171 |

*Primary Examiner*—Lloyd A. Gall

*Attorney, Agent, or Firm*—Townsend and Townsend

[57] ABSTRACT

An improved key safe for a door wherein the door has a hole therethrough. A hollow key holder is shiftably mounted in the hole. A spring exerts a bias force against the key holder in the hole of the door so that the key holder and key held thereby will be automatically ejected into an adjacent room and become completely inaccessible to an intruder. Ejection of the holder occurs when a hold-down means at the opposite end of the holder is forced off the holder in any manner, such as by using a crowbar, screwdriver or the like. The hold-down means will preferably be an O-ring seated in an annular groove at the opposite end of the holder. When unseated from the groove, the hold-down means moves off the holder, thus permitting the holder to be projected off the door and into the adjacent room under the influence of the bias force of the spring. Since the door is locked, an intruder will be prevented from reaching the key for unlocking the door.

11 Claims, 3 Drawing Sheets

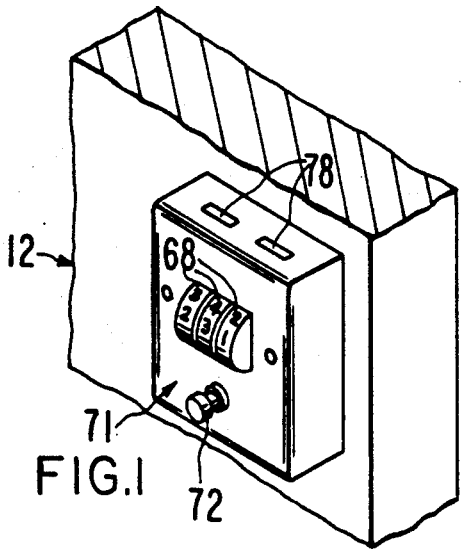
FIG.1
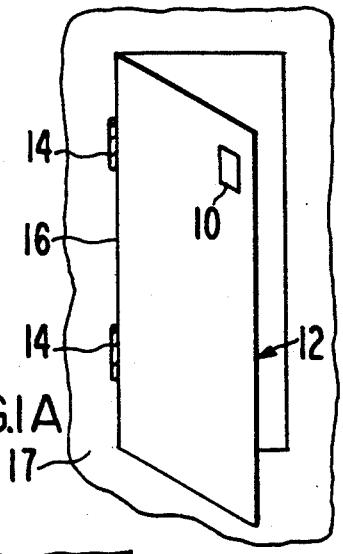
FIG.1A
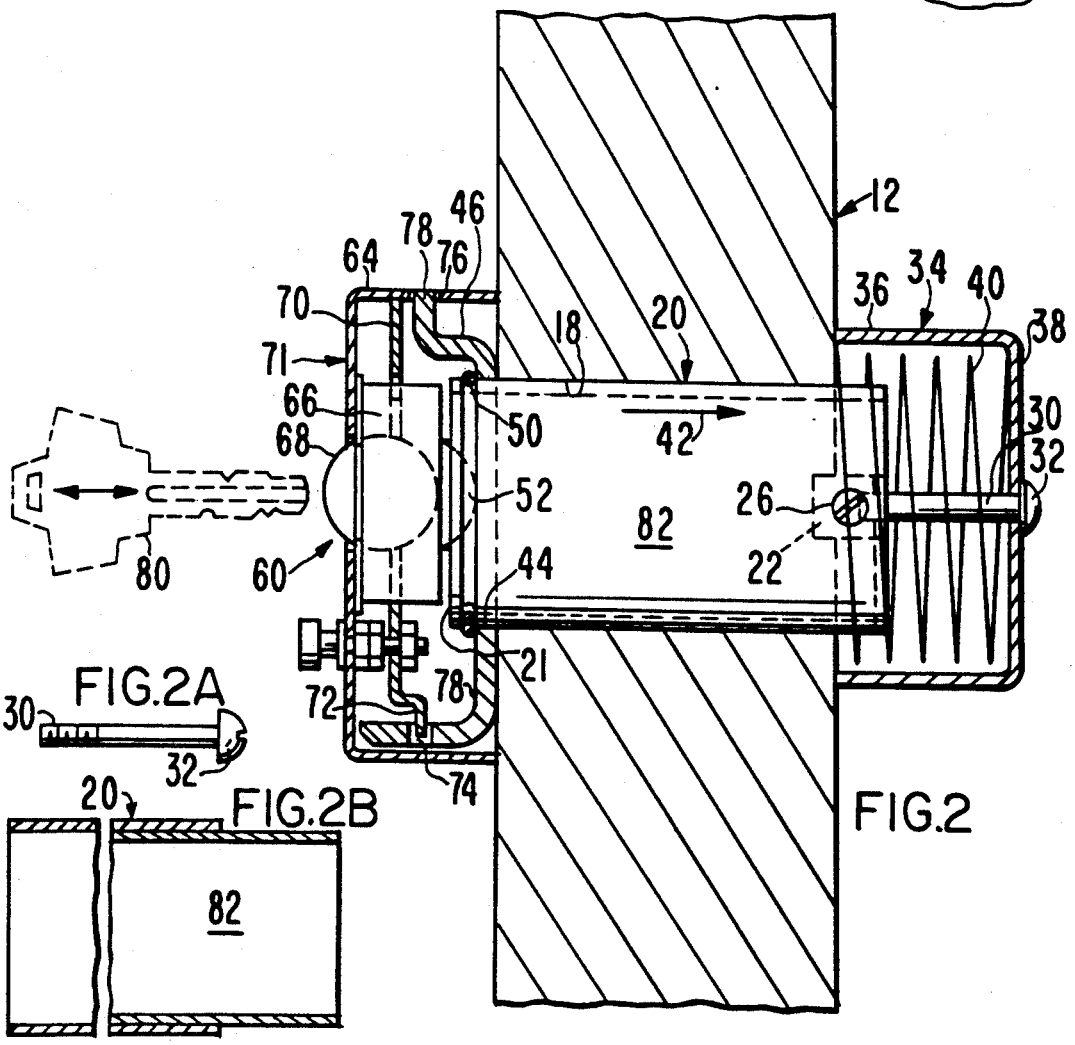
FIG.2A
FIG.2B
FIG.2

30
34
40
12
46
76
20
81
50
80
70
66
68
64
71
78

20
25
26
52

KEY SAFE FOR DOOR

This invention relates to improvements in the security of doors and the like and, more particularly, to a safe for attachment to a door for removably receiving a key in the safe, yet the safe permits access to the key when the key is needed to unlock the door.

BACKGROUND OF THE INVENTION

Key safes for doors have been known and used in the past. Such a key safe usually contains a key to be used in case of the loss of the usual house key. The key safe can be used as a lock box of a realtor for showing a house to a prospective purchaser, or a lock box for allowing access to delivery and service personnel in the absence of the resident.

Security devices having some relation to the key safe of the present invention are disclosed in the following U.S. Patents:

| U.S. Pat. Nos. | |
|---|---|
| 4,829,796 | 3,677,042 |
| 4,615,281 | 3,411,046 |
| 4,467,628 | 3,084,008 |
| 4,354,367 | 2,732,816 |
| 4,296,617 | 2,253,332 |
| 3,820,363 | 2,139,909 |
| 3,800,571 | 1,885,692 |
| 3,795,417 | 1,590,007 |

SUMMARY OF THE INVENTION

The present invention provides an improved key safe for a door wherein the door has a hole therethrough. A hollow key holder is shiftably mounted in the hole. A spring exerts a bias force against the key holder in the hole of the door so that the key holder and key held thereby will be automatically ejected into an adjacent room and become completely inaccessible to an intruder. Ejection of the holder occurs when a hold-down means at the opposite end of the holder is forced off the holder in any manner, such as by using a crowbar, screwdriver or the like. The hold-down means will preferably be an O-ring seated in an annular groove at the opposite end of the holder. When unseated from the groove, the hold-down means moves off the holder, thus permitting the holder to be projected off the door and into the adjacent room under the influence of the bias force of the spring. Since the door is locked, an intruder will be prevented from reaching the key for unlocking the door.

The primary object of the present invention is to provide an improved key safe for a normally locked door wherein a hollow key holder is biased in one direction to cause the key holder to be projected out of the door and ejected into the interior of an adjacent space which is not accessible due to the locked door when the key safe is tampered with.

A second object of this invention is to provide an improved key safe that may be attached to a door in a visible but secure location that enables the intended user to find it in the dark of night or light of day without a frustrating search, i.e. it will not be hidden in a bush, under a rock, or attached to a natural gas meter or pipe somewhere in the backyard.

Other objects of this invention will become apparent as the following specification progresses, reference being had to the accompanying drawings for an illustration of the invention.

BRIEF DESCRIPTION OF THE DRAWINGS

FIG. 1A is a schematic view, on a reduced scale, of the key safe on a door;

FIG. 1 is a fragmentary perspective view of a door showing the key safe of the present invention attached thereto;

FIG. 2 is an enlarged, fragmentary vertical section of the door with the key safe shown in cross-section;

FIG. 2A is a side elevation view of a screw of a different length to accommodate doors of different thicknesses;

FIG. 2B is a vertical section through a modified holder for a key, the holder having telescoping parts to vary the length of the holder and thereby permit compensation for doors of different thicknesses;

DETAILED DESCRIPTION OF THE EMBODIMENT

Figure 3:
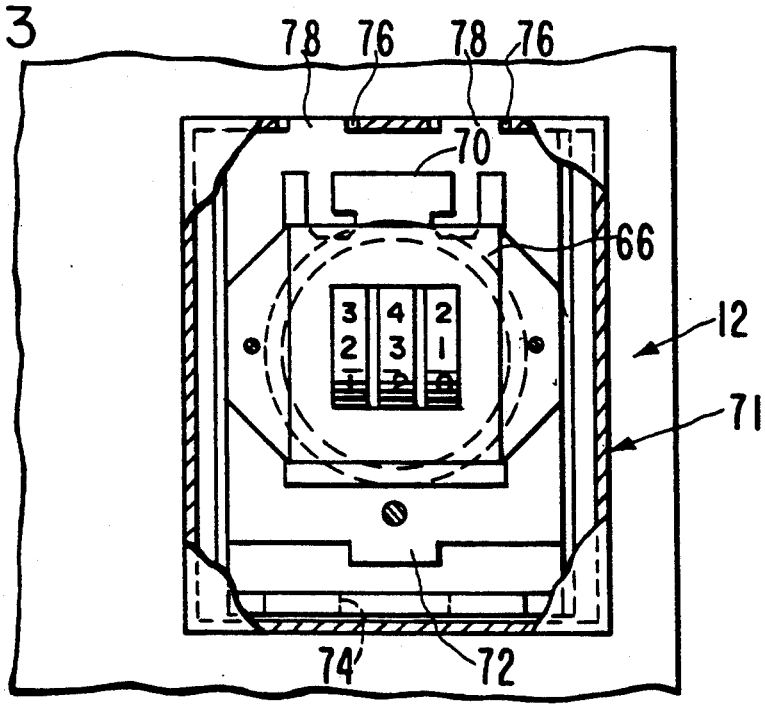
FIG. 3 is an enlarged, fragmentary front elevational view of the key safe, parts being broken away and in section to reveal details of construction.

A key safe 10 is provided for a door 12 which is swingably mounted by hinge 14 for rotation about a vertical axis 16 on a wall 17. Key safe 10 can be at any location on door 12. FIG. 1A shows the key safe 10 near the upper right-hand corner of door 12 but it is clear that the key safe can be at another location, if desired.

Key safe 10 includes a cylindrical member or key holder 20 which is open at one or both ends thereof and is of a length slightly greater than the thickness of the door 12 as shown in FIG. 2. Key holder 20 is slidably received in a cylindrical hole 18 (FIGS. 2 and 4) in door 12.

Figure 4:
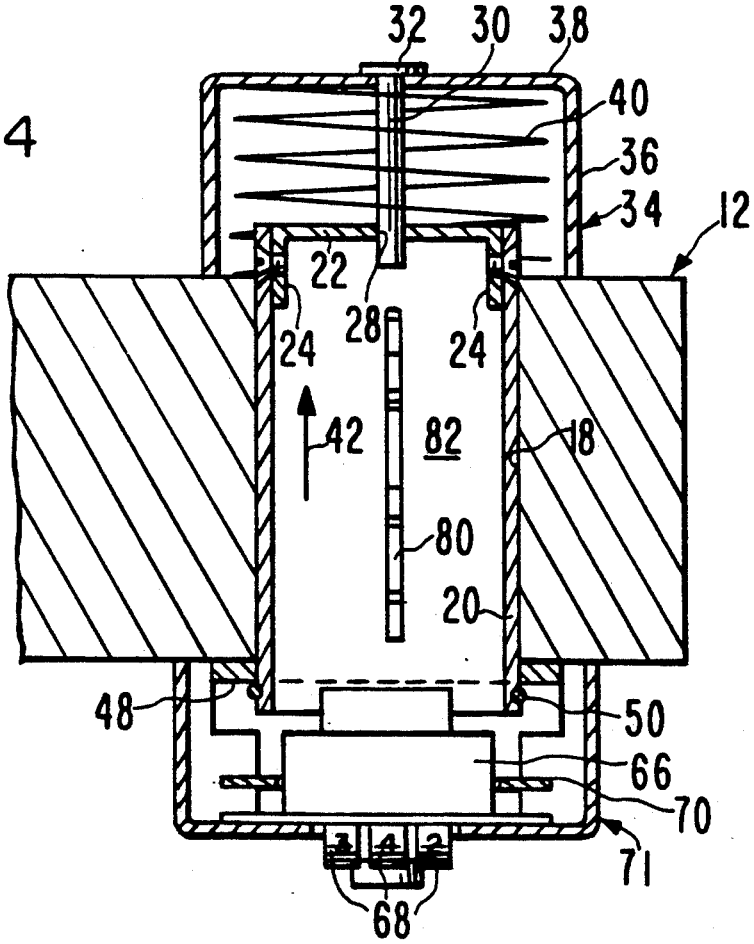
FIG. 4 is a horizontal section through the door and the central portion of the key safe attached to the door.

One end of holder 20 is provided with a cross piece 22 which has a pair of end flanges 24 (FIG. 4) provided with threaded holes 25 (FIG. 7) for receiving a pair of flathead screws 26 (FIGS. 2 and 7) for coupling the holder 20 with member 22 as shown in FIG. 4. This one end of the holder 20 can be closed, if desired.

Cross piece 22 has a threaded hole 28 for threadably receiving a screw 30 having a head 32. The screw passes through the central axis of a cylindrical closure cap 34 having a cylindrical sidewall 36 and a disk-like end wall 38. Cap 34 contains a coil spring 40 in surrounding relationship to screw 30 with the spring being in compression so as to bias holder 20 in a direction to the right when viewing FIG. 2 as denoted by the arrow 42 (FIGS. 2 and 4).

Figures 5, 6, 7:
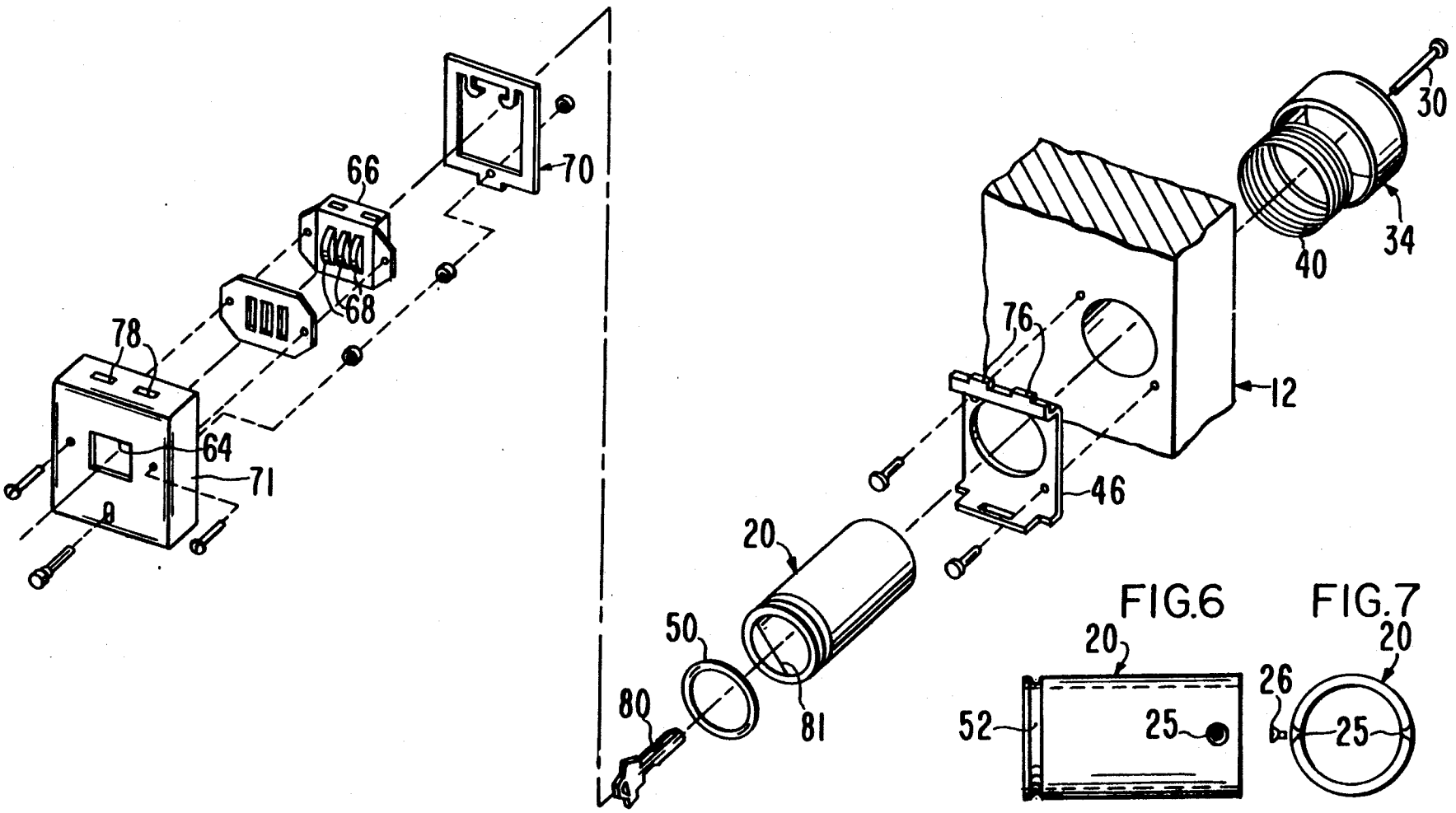
FIG. 5 is an exploded view of the key safe illustrating the order in which the parts are arranged and attached to the door.
FIG. 6 is a side elevational view of a cylinder forming the key of the key safe.
FIG. 7 is an end elevational view of the cylinder of FIG. 6.

The opposite end of holder 20 extends through a central hole 44 in a flange element 46 having an annular front face 48 (FIGS. 2 and 4). A resilient hold-down means, such as an O-ring 50 is seated in an annular groove 52 (FIGS. 6). O-ring 50 bears against front face 48 of flange element 46 to effectively retain holder 20 in a fixed position in the hole 18 through the door 12 as shown in FIG. 2. If the O-ring were not present, the spring 40 would cause movement of the holder 20 out of the door to the right as shown in FIG. 2 because of the bias force of spring 40 under compression.

A lock 60 is associated with the flange element 46 and includes a lock box 66 within the hollow space of a hollow cover 71 containing a plurality of rotatable locking dials or wheels 68. There are three dials 68, but there could be more or fewer locking wheels 68, if desired. The dials or wheels project partially through a central opening 64 in cover 71. The dials or wheels 68 can be manually rotated into the desired positions to unlock the lock 60, thus making lock 60 a combination lock.

Built into this lock is a release mechanism (not shown) that allows the combination of lock 60 to be changed once delivery or service personnel have performed their duties, and their knowledge of the combination of the lock is no longer needed.

A locking plate 70 is carried by lock box 66 and can be raised and lowered when the wheels 68 are set to predetermined rotative positions to unlock the lock 60. When this occurs, a projection 72 on plate 70 and accessible from a location in front of cover 71 is manually lifted out of a bottom slot 74 in flange element 46. Simultaneously, the box 66 can be taken off the projections 76 (FIG. 5) which extend through slots 78 (FIGS. 1 and 5) in a top surface of cover 71.

In use, key safe 10 is adapted to contain a key 80 in the interior space 82 of holder 20 (FIG. 2). This key could be an extra key for the occupant of the house having the door. In the alternative, it can be a key which is to be used by realtors, deliver and service personnel, etc., in gaining access to an empty house to be shown to prospective purchasers of the house.

The key 80 is inserted into the partially open end 21 (FIG. 2) of holder 20 behind the downwardly facing oval lip 81 (FIG. 5), which prevents the key 80 from being suspended in space when spring 40 is released, thereby allowing the key 80 to remain within hole 18 of door 12, making it inaccessible to an intruder when the O-ring 50 is in the groove 52 (FIG. 6). Thus, the O-ring retains holder 20 against movement to the right when viewing FIG. 2. Such movement would occur because of the bias action of spring 40 if the O-ring were not in place in the groove 52.

The cover 71 is then moved into a position covering the front end of holder 20, and the wheels 68 are rotated to move the wheels out of the combination needed to open the key safe 10 to gain access to the key 80.

When it is desired to gain access to the key of door safe 10, wheels 68 are rotated to the proper positions to unlock the lock 60, whereupon plate 70 can be manually raised to move projection 72 out of slot 74. The lock box 66 and cover 71 can then be lifted off projections 76 of flange element 46 so as to remove the cover from attachment to the flange element 46. This leaves the front end of holder 20 open and the key can be lifted out of the holder through the front open end of the holder.

The key can then be used to unlock the door 12, whereupon the key will usually be replaced in the compartment 82 and the lock 60 can then be put back in place on the flange element 46 and locked by rotating the wheels 68.

If an intruder were to try to separate flange element 46 from door 12, the natural tendency of the intruder would be to take a crow bar or a screwdriver and try to dislodge flange element 46 from attachment with door 12. When this occurs, the flange element 46 can possibly be moved slightly to the left as viewed in FIG. 2. However, O-ring 50 will be forced by the element 46 out of groove 52 and to the left when viewing FIG. 2. When this occurs, spring 40 will expand, causing cap 34 and holder 20 to be projected from the door and ejected into the space adjacent to the door 12. The key will be carried by the holder 20 to an interior location sufficiently far from the door 12 so that the intruder cannot gain access to the key since the door will be locked. The intruder will then leave the premises without getting the key and without gaining access to the interior of the house or home of which the door 12 is a part.

To accommodate different door thicknesses, screws of varying sizes (FIG. 2A) will accompany the key safe 10 to allow for telescoping (FIG. 2B) or attachment to the closure cap 34 and thereby compensate for different door thicknesses.

What is claimed is:

1. A key safe for a door comprising:
means adapted to extend through the door for removably holding a key on the door;
means coupled with the holding means for biasing the holding means in a direction away from the door;
means including a resilient ring for releasably retaining the holding means in a fixed position in the door against the bias force of said bias means; and
cover means to cover the holding means when a key is held thereby; and
lock means for locking the cover means to the holding means to prevent access to the key held thereby.

2. A key safe as set forth in claim 1, wherein said bias means is at one end of the holding means.

3. A key safe as set forth in claim 1, wherein said lock means and said cover means are located near a first end of the holding means.

4. A key safe as set forth in claim 1, wherein said lock means includes a resettable combination lock carried by the cover means.

5. A key safe as set forth in claim 1, wherein said safe includes a flange element having a slot, said lock means including a shiftable lock plate having a marginal edge removably insertable into the slot of the flange element to lock the cover means to the flange element, said lock means being released when the marginal edge of the locking plate moves out of the slot of the flange element and thereby allow removal of the cover means from the flange element to thereby permit access to the holding means.

6. A key safe as set forth in claim 1, wherein said holding means includes a tubular holder having a pair of open ends with a lip for partially closing one end to assure the key held within will be ejected into the interior from the door.

7. A key safe as set forth in claim 1, wherein is provided mounting screws of different lengths to accommodate doors of different thicknesses.

8. A key safe as set forth in claim 1, wherein said holding means includes a cylindrical holder for slidable insertion in the door.

9. A key safe as set forth in claim 8, wherein said holder has telescopic parts to vary the length of the holder and thereby permit compensation for doors of different thicknesses.

10. A key safe for a door comprising:
means adapted to extend through the door for removably holding a key on the door;
means coupled with the holding means for biasing the holding means in a direction extending away from the door, said holding means including a cylindrical member having an open end, means near one end of the cylindrical member for providing a base, a screw coupled to the base, a shell held at one face of the door by the screw;

means for releasably retaining the holding means in a fixed position in the door against the bias force of said bias means, said bias means including a coil spring within the shell and surrounding the screw, said spring normally being under compression;

cover means to cover the holding means when a key is held thereby; and lock means for locking the cover means to the holding means to prevent access to the key held thereby.

11. A key safe for the door comprising:

means adapted to extend through the door for removably holding a key on the door;

means coupled with the holding means for biasing the holding means in a direction extending away from the door;

a flange element having a marginal edge, said holding means including a cylindrical member having an O-ring carried on one end thereof, said flange element being operable to remove the O-ring from the cylindrical member when the flange element is moved relative to the door, whereby the bias means will exert a bias force to the cylindrical member to cause the latter to shift away from the door and to be ejected in a direction away from the flange element;

means for releasably retaining the holding means in a fixed position in the door against the bias force of said bias means;

cover means to cover the holding means when a key is held thereby; and lock means for locking the cover means to the holding means to prevent access to the key held thereby.

* * * * *